US008317446B2

(12) United States Patent
Cyr et al.

(10) Patent No.: US 8,317,446 B2
(45) Date of Patent: Nov. 27, 2012

(54) SYSTEM AND METHOD FOR TREATING PRINTED FLEXIBLE BOOK COVERS PRIOR TO BINDING

(75) Inventors: Brian C. Cyr, Penfield, NY (US); Jacob Eyngorn, Penfield, NY (US); Aaron M. Moore, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 130 days.

(21) Appl. No.: 12/848,117

(22) Filed: Jul. 31, 2010

(65) Prior Publication Data

US 2012/0027540 A1 Feb. 2, 2012

(51) Int. Cl.

| | |
|---|---|
| ***B42D 1/00*** | (2006.01) |
| ***B42D 3/00*** | (2006.01) |
| ***B42D 15/10*** | (2006.01) |
| ***B42C 9/00*** | (2006.01) |

(52) U.S. Cl. ..... 412/6; 281/21.1; 281/29; 281/36; 283/72; 412/1; 412/8; 412/33; 412/37; 412/900; 412/901

(58) Field of Classification Search ..... 281/21.1, 281/29, 36; 283/72; 412/1, 6, 8, 33, 37, 412/900, 901

See application file for complete search history.

(56) References Cited

U.S. PATENT DOCUMENTS

| | | | | |
|---|---|---|---|---|
| 4,536,012 | A * | 8/1985 | Hume, III | 412/8 |
| 4,984,949 | A | 1/1991 | Reckziegel | |
| 5,672,030 | A * | 9/1997 | Dean | 412/8 |
| 6,032,004 | A | 2/2000 | Mirabella, Jr. et al. | |
| 6,186,935 | B1 * | 2/2001 | Wiholm | 412/8 |
| 6,743,561 | B2 | 6/2004 | Heeks et al. | |
| 6,782,144 | B2 | 8/2004 | Bellavita et al. | |
| 6,928,183 | B2 | 8/2005 | Mitchell et al. | |
| 7,291,399 | B2 | 11/2007 | Kaplan et al. | |
| 7,799,568 | B2 * | 9/2010 | Charles et al. | 283/72 |
| 2003/0007052 | A1 | 1/2003 | Huang et al. | |
| 2004/0137203 | A1 | 7/2004 | Adams et al. | |
| 2005/0220518 | A1 | 10/2005 | Priebe | |
| 2005/0285918 | A1 | 12/2005 | McElligott et al. | |
| 2007/0290053 | A1 | 12/2007 | Bov et al. | |
| 2008/0101836 | A1 * | 5/2008 | Fujita et al. | 281/21.1 |
| 2009/0097892 | A1 | 4/2009 | Murakami et al. | |
| 2009/0303305 | A1 | 12/2009 | Cellura et al. | |
| 2010/0079560 | A1 | 4/2010 | Derimiggio et al. | |

* cited by examiner

*Primary Examiner* — Dana Ross
*Assistant Examiner* — Justin V Lewis
(74) *Attorney, Agent, or Firm* — Gibb & Riley, LLC

(57) ABSTRACT

Disclosed are embodiments of a system and method for treating a printed flexible book cover prior to book binding. In the embodiments, a liquid (e.g., water or a water-oil solvent mixture) can be applied (e.g., by a liquid applicator, such as a spray nozzle, sponge, brush, etc.) to the spine portion only of the book cover so that it pools on the surface. After a predetermined amount of time, the liquid can be removed (e.g., by a liquid remover, such as a vacuum, blower, heater, etc.). Allowing the spine portion of the book cover to soak in the liquid for this predetermined amount of time ensures that the liquid saturates the spine portion. Saturating the spine portion of the book cover alters the surface structure and, thereby enhances adhesion of an adhesive material (e.g., glue or tape) during a subsequent book binding process even in the presence of fuser oil.

20 Claims, 6 Drawing Sheets

SYSTEM AND METHOD FOR TREATING PRINTED FLEXIBLE BOOK COVERS PRIOR TO BINDING

BACKGROUND

Embodiments herein generally relate to book binding processes and, more particularly, to a system and method for treating printed flexible book covers prior to book binding.

Flexible book covers (i.e., soft cover book covers, such as paper book covers) are typically printed by an electrostatographic image reproduction machine (e.g., an electrostatographic printer, copier or other the like) prior to book binding. With such electrostatographic image reproduction machines, toner images are fused onto one or both sides of a print media sheet (in this case, the flexible book cover) by a fuser. Specifically, a typical electrostatographic image reproduction machine imparts toner images onto a print media sheet and then passes the print media sheet through a fuser. The fuser applies heat and/or pressure in order to fuse (i.e., fix) the toner particles, which form the toner images, onto the print media sheet. However, during this fusing process, toner particles may transfer onto the fuser and, thereby onto other parts of the machine or onto subsequently printed print media sheets. This offset of toner particles can be inhibited or prevented by applying a thin film of fuser oil (e.g., silicon oil) onto the surface of the fuser. Unfortunately, fuser oil can transfer onto and be absorbed by print media sheets during the fusing process and can interfere with subsequent processing. For example, in the case of a flexible printed book cover, fuser oil that is transferred onto and absorbed by the spine portion of the book cover can prevent adequate adhesion of adhesive material (e.g., glue or tape) during a subsequent book binding process (e.g., a perfect bound book binding process or a tape binding process).

SUMMARY

In view of the foregoing, disclosed herein are embodiments of a system and method for treating a printed flexible book cover (i.e., a soft cover book cover, such as a paper book cover) and, particularly, the spine portion of a printed flexible book cover prior to book binding. Specifically, in the embodiments a liquid (e.g., water or a mixture of water and an oil solvent) can be applied (e.g., by a liquid applicator, such as a spray nozzle, sponge, brush, etc.) to the spine portion of a printed flexible book cover so that it pools on the surface. Then, after a predetermined amount of time, the liquid can be removed (e.g., by a liquid remover, such as a vacuum, blower, heater, etc.). Allowing the spine portion of the book cover to soak in the liquid for this predetermined amount of time ensures that that the liquid saturates the spine portion. Saturating the spine portion of the printed flexible book cover alters the surface structure and, thereby enhances adhesion of an adhesive material (e.g., glue or tape) during a subsequent book binding process (e.g., a perfect bound book binding process or a tape binding process) even in the presence of fuser oil.

More particularly, disclosed herein are embodiments of a system for treating a printed flexible book cover (i.e., a soft cover book cover, such as a paper book cover) prior to book binding. The printed flexible book cover can comprise side portions and a center portion positioned laterally between the side portions. The center portion can extend from a first edge of the book cover to a second edge opposite the first edge. The system embodiments can comprise one or more sheet transport devices, a liquid applicator, and a liquid remover.

The sheet transport device(s) can transport the book cover, in sheet form, along a sheet transport path past the liquid applicator, from the liquid applicator to the liquid remover and past the liquid remover. As the printed flexible book cover is being transported along the sheet transport path, it can be oriented such that the first edge is the leading edge and the second edge is the trailing edge.

When the leading edge of the book cover reaches and is then transported past the liquid applicator, the liquid applicator can apply a liquid (e.g., water or a mixture of water and an oil solvent) to the surface of the center portion of the book cover from the leading edge to the trailing edge. Application of the liquid can specifically be performed such that a pool of the liquid covers the center portion without extending laterally across the side portions. In one embodiment of the system, the liquid applicator can comprise a spray nozzle that sprays the liquid onto the center portion of the book cover. This spray nozzle can have a spray pattern with a width that is approximately equal to the width of the center portion so that the liquid pools only the surface of the center portion without extending laterally across the side portions. Alternatively, the liquid applicator can comprise a sponge, a brush or a roller that sponges, brushes or rolls, respectively, the liquid onto the center portion of the book cover. Such applicators can have a width that is approximately equal to the width of the center portion so that the liquid pools only the surface of the center portion without extending laterally across the side portions.

When the leading edge of the book cover reaches and is then transported past the liquid remover, the liquid remover can remove the liquid from the surface of the center portion of the book cover from the leading edge to the trailing edge. In one embodiment of the system, the liquid remover can comprise a vacuum nozzle that vacuums away the liquid. Alternatively, the liquid remover can comprise a heater that evaporates away the liquid and/or a blower that blows away the liquid.

As mentioned above, the sheet transport device(s) can transport the book cover along the sheet transport path past the liquid applicator, from the liquid applicator to the liquid remover and past the liquid remover. The sheet transport device(s) can do so without contacting the liquid on the surface of the book cover. To accomplish this, the sheet transport device(s) can comprise a plurality of nip rollers engaging side edges only of the book cover, where the side edges are essentially perpendicular to the leading and trailing edges and are essentially parallel to the center portion. Alternatively, the sheet transport device(s) can comprise electrostatic transport belt(s).

Additionally, the sheet transport device(s) can take a predetermined amount of time (e.g., 1 second) to transport the book cover from the liquid applicator to the liquid remover. This predetermined amount of time can be set so that the liquid saturates the center portion the book cover and, thereby alters the surface structure of the center portion. For example, in the case of a paper book cover, the predetermined amount of time can be set so that the liquid (i.e., water or water-oil solvent mixture) saturates the paper in the center portion causing swelling of the paper fibers and resulting in an altered surface structure. Altering the surface structure of the book cover and, particularly, the surface structure of the center portion of the book cover in this manner enhances adhesion of an adhesive material to the center portion during a subsequent book binding process and, specifically, does so without requiring removal of fuser oil remaining on the flexible book cover after it was printed.

Also disclosed herein are embodiments of an associated method for treating a printed flexible book cover (i.e., a soft cover book cover, such as a paper book cover) prior to book binding. The method embodiments can comprise receiving a printed flexible book cover. This book cover can comprise side portions and a center portion positioned laterally between the side portions. The center portion can extend from a first edge of the book cover to a second edge opposite the first edge. The method embodiments can further comprise transporting the book cover along a sheet transport path. As the book cover is being transported along the sheet transport path, it can be oriented such that the first edge is the leading edge and the second edge is the trailing edge.

The method embodiments can further comprise, as the book cover is being transported, applying a liquid (e.g., water or a mixture of water and an oil solvent) to the surface of the center portion of the book cover from the first edge (i.e., the leading edge) to the second edge (i.e., the trailing edge). This process of applying the liquid can be performed such that a pool of the liquid covers the center portion without extending laterally across the side portions. In one embodiment of the method, the liquid can be applied by spraying it onto the center portion of the book cover (e.g., using a spray nozzle). This spray nozzle can have a spray pattern with a width that is approximately equal to the width of the center portion so that the liquid pools only the surface of the center portion without extending laterally across the side portions. Alternatively, the liquid can be applied by sponging it on, brushing it on or rolling it on. Applicators for such techniques (e.g., a sponge, a brush, and a passive roller, respectively) can similarly have a width that is approximately equal to the width of the center portion so that the liquid pools only the surface of the center portion without extending laterally across the side portions.

The method embodiments can further comprise, after a predetermined amount of time (e.g., 1 second), removing the liquid from the surface of the book cover. In one embodiment of the method, the process of removing the liquid can comprise vacuuming away the liquid. Alternatively, the process of removing the liquid can comprise applying heat to evaporate away the liquid and/or blowing away the liquid. The predetermined amount of time between application and removal of the liquid can be set to ensure that the liquid saturates the center portion altering the structure of the surface of the center portion. For example, in the case of a paper book cover, the predetermined amount of time can be set so that the liquid (i.e., water or water-oil solvent mixture) saturates the paper in the center portion causing swelling of the paper fibers and resulting in an altered surface structure. Altering the surface structure of the book cover and, particularly, the surface structure of the center portion of the book cover in this manner enhances adhesion of an adhesive material to the center portion during a subsequent book binding process and does so without requiring removal of any fuser oil remaining on the flexible book cover after it was printed.

These and other features are described in, or are apparent from, the following detailed description.

BRIEF DESCRIPTION OF THE DRAWINGS

Various exemplary embodiments of the disclosed system and method are described in detail below, with reference to the attached figures, in which.

DETAILED DESCRIPTION

Figure 8:
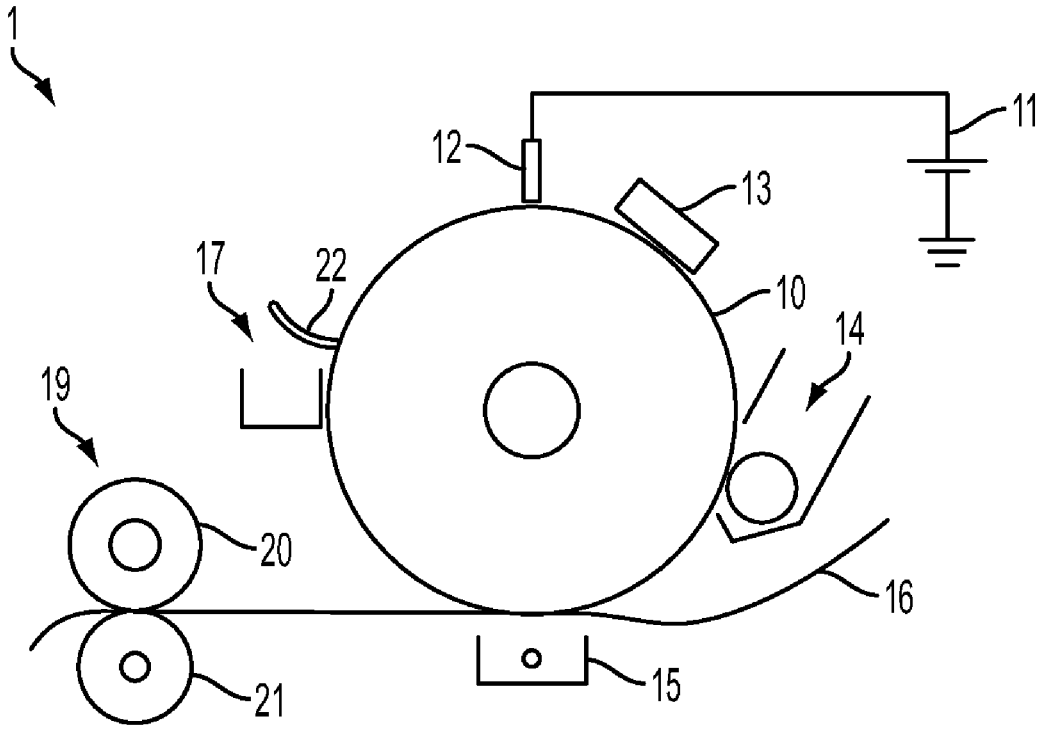
FIG. 8 is a schematic diagram illustrating an exemplary print engine that can be used to print the flexible book cover treated by the system of FIG. 1 or according to the method of FIG. 7.

As discussed above, in electrostatographic image reproduction machines (e.g., electrostatographic printers, copiers or other the like), a toner image is usually fused onto a print media sheet by a fuser. Specifically, in a typical electrostatographic image reproduction machine 1, as illustrated in FIG. 8 and discussed in detail in U.S. Pat. No. 7,291,399 of Kaplan et al., issued on Nov. 6, 2007, assigned to Xerox Corporation of Norwalk, Conn., USA, a photoreceptor 10 is charged on its surface by means of a charger 12 to which a voltage has been supplied from power supply 11. The photoreceptor 10 is exposed to light from an optical system or an image input apparatus 13, such as a laser and/or light emitting diode, to form an electrostatic latent image thereon. Generally, the electrostatic latent image is developed by bringing a developer mixture of toner particles from developer station 14 into contact with the latent image (e.g., by use of a magnetic brush, powder cloud, or other known development process). After the latent image is developed (i.e., after the toner particles have been deposited onto the photoreceptor forming the toner image), the toner image is transferred from the photoreceptor 10 to a print media sheet 16 by a transfer means 15 that employs, for example, pressure transfer techniques, electrostatic transfer techniques, or the like. Alternatively, the toner image can be transferred from the photoreceptor 10 to an intermediate transfer member (e.g., an image transfer belt) and then subsequently transferred from the intermediate transfer member to the print media sheet 16.

After the toner image is transferred to the print media sheet 16, the photoreceptor 10 rotates through a cleaning station 17, where toner particles left on the photoreceptor 10 are removed by cleaning member 22 (e.g., a blade, brush, or other cleaning apparatus). Additionally, the print media sheet 16 is advanced along a sheet transport path through a fuser 19 (i.e., a fusing station) comprising, for example, fusing and pressure rolls that apply heat and pressure in order to fuse (i.e., fix) the toner particles forming the toner image onto the print media sheet 16.

Oftentimes, during this fusing process, toner particles may transfer onto the fuser 19 and, thereby onto other parts of the image reproduction machine or onto subsequently printed print media sheets. This offset of toner particles can be inhibited or prevented by applying a thin film of fuser oil (e.g., silicon oil) onto the surface of the fuser 19. Unfortunately, fuser oil can transfer onto the print media sheets during the fusing process and can interfere with subsequent processing. For example, in the case of a printed flexible book cover, fuser oil transferred onto and absorbed by the spine portion of the book cover can prevent adequate adhesion of adhesive material (e.g., glue or tape adhesion) during a subsequent book binding process (e.g., a perfect bound book binding process or a tape binding process). That is, the fuser oil sits on the surface of the book cover and acts as a barrier between the adhesive material and the spine portion of the book cover so that the book cover can not be attached to the spine of the book.

In view of the foregoing, disclosed herein are embodiments of a system and method for treating a printed flexible book cover (i.e., a soft cover book cover, such as a paper book cover) and, particularly, the spine portion of a printed flexible book cover prior to book binding. Specifically, in the embodiments a liquid (e.g., water or a mixture of water and an oil solvent) can be applied (e.g., by a liquid applicator, such as a spray nozzle, sponge, brush, etc.) to the spine portion of printed flexible book cover so that it pools on the surface. Then, after a predetermined amount of time, the liquid can be removed (e.g., by a liquid remover, such as a vacuum, blower, heater, etc.). Allowing the spine portion of the book cover to soak in the liquid for this predetermined amount of time ensures that that the liquid saturates the spine portion. Saturating the spine portion of the printed flexible book cover alters the surface structure and, thereby enhances adhesion of an adhesive material (e.g., glue or tape) during a subsequent book binding process (e.g., a perfect bound book binding process or a tape binding process) even in the presence of fuser oil.

Figure 1:
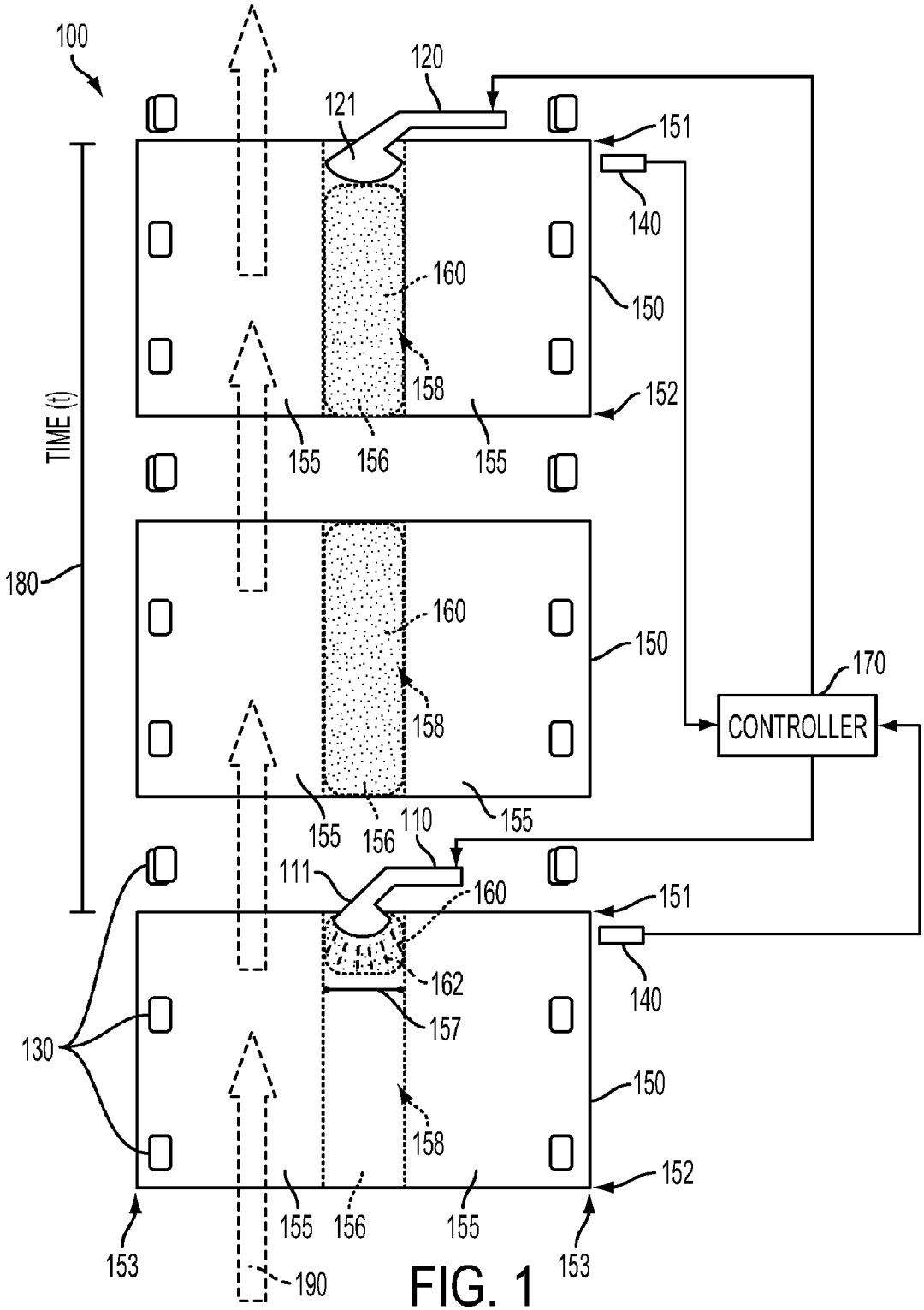
FIG. 1 is a schematic diagram illustrating a system for treating a printed flexible book cover prior to book binding.

More particularly, referring to FIG. 1, disclosed herein are embodiments of a system 100 for treating a printed flexible book cover 150 prior to book binding. The book cover 150 can comprise, for example, a soft cover book cover, such as a paper book cover. This book cover 150 can be printed (e.g., by an electrostatographic image reproduction machine, as discussed above and shown in FIG. 8) with toner images fused onto one or both surfaces (i.e., on the inside surface 158 and/or the outside surface). Thus, both the inside surface 158 and outside surface of the book cover 150 may contain transferred fuser oil. This book cover 150 can further comprise side portions 155 (i.e., front and back cover portions) and a center portion 156 (i.e., a spine portion) positioned laterally between the side portions 155. The center portion 156 can extend from a first edge 151 to a second edge 152 opposite the first edge 151.

The system 100 embodiments can comprise one or more sheet transport devices 130, a liquid applicator 110, a liquid remover 120, and one or more edge sensors 140.

The sheet transport device(s) 130 can transport (i.e., can be adapted to transport, configured to transport, etc.) the book cover 150, in sheet form (e.g., sized between 8½×11 inches and 14.33×22.5 inches) along a sheet transport path 190 with the first edge 151 oriented as the leading edge and the second edge 152 oriented as the trailing edge. The sheet transport device(s) 130 can specifically transport the book cover 150 along the sheet transport path 190 such that the book cover 150 moves past the liquid applicator 110, from the liquid applicator 110 to the liquid remover 120 and past the liquid remover 120.

Once the leading edge 151 of the book cover 150 reaches the liquid applicator 110 (e.g., as determined by a leading edge sensor 140), the liquid applicator 110 can automatically activate (i.e., turn on). It should be noted that edge sensors are well-known in the art and, thus, the details of such edge sensors are omitted from this specification in order to allow the reader to focus on the salient aspects of the invention. As the book cover 150 passes by the liquid applicator 110, the liquid applicator 110 can apply (i.e., can be adapted to apply, configured to apply, etc.) a liquid 160 to the surface 158 of the center portion 156 of the book cover 150 from the leading edge 151 to the trailing edge 152. That is, the liquid applicator 110 can wet the surface 158 of the center portion 156. Application of the liquid 160 can specifically be performed such that a pool (i.e., a standing puddle, a collection, etc.) of the liquid 160 covers the center portion 156 without extending laterally across the side portions 155 (i.e., such that the liquid pools on only the center portion 156 of the book cover 150). This liquid 160 can comprise, for example, purified water. Alternatively, the liquid 160 can comprise a mixture of water and an oil solvent (e.g., a commercially available oil solvent, such as an Eatoils™ product).

Figure 2:
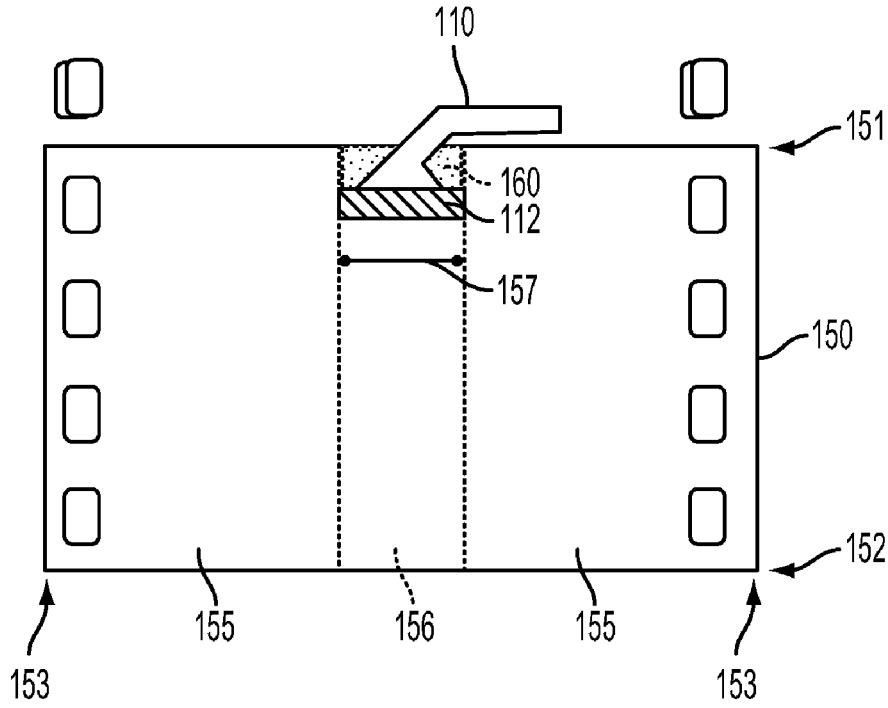
FIG. 2 is a schematic diagram illustrating an alternative liquid applicator that can be incorporated into the system of FIG. 1.
Figure 3:
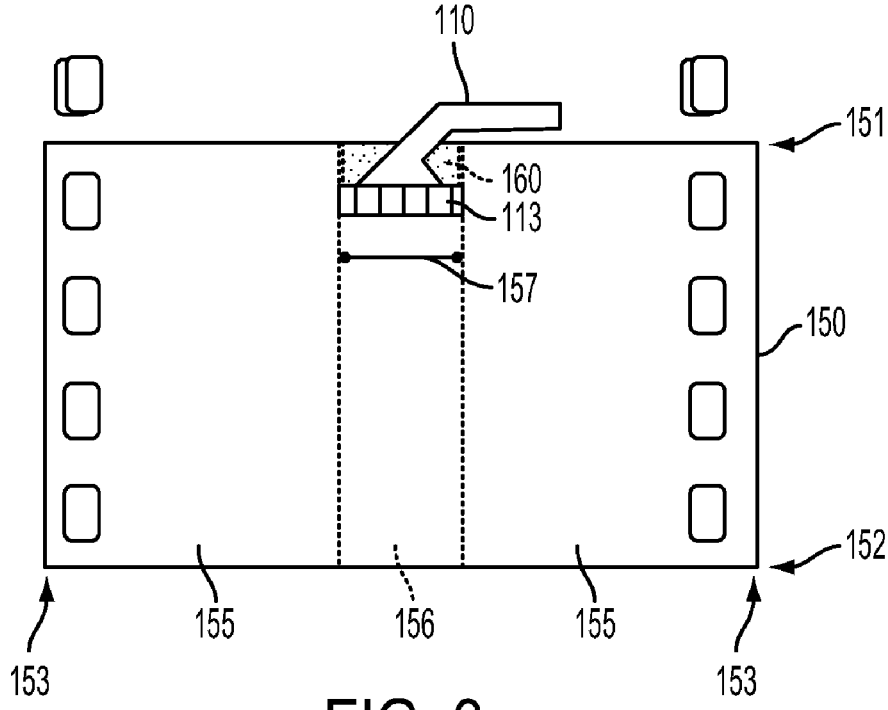
FIG. 3 is a schematic diagram illustrating another alternative liquid applicator that can be incorporated into the system of FIG. 1.
Figure 4:
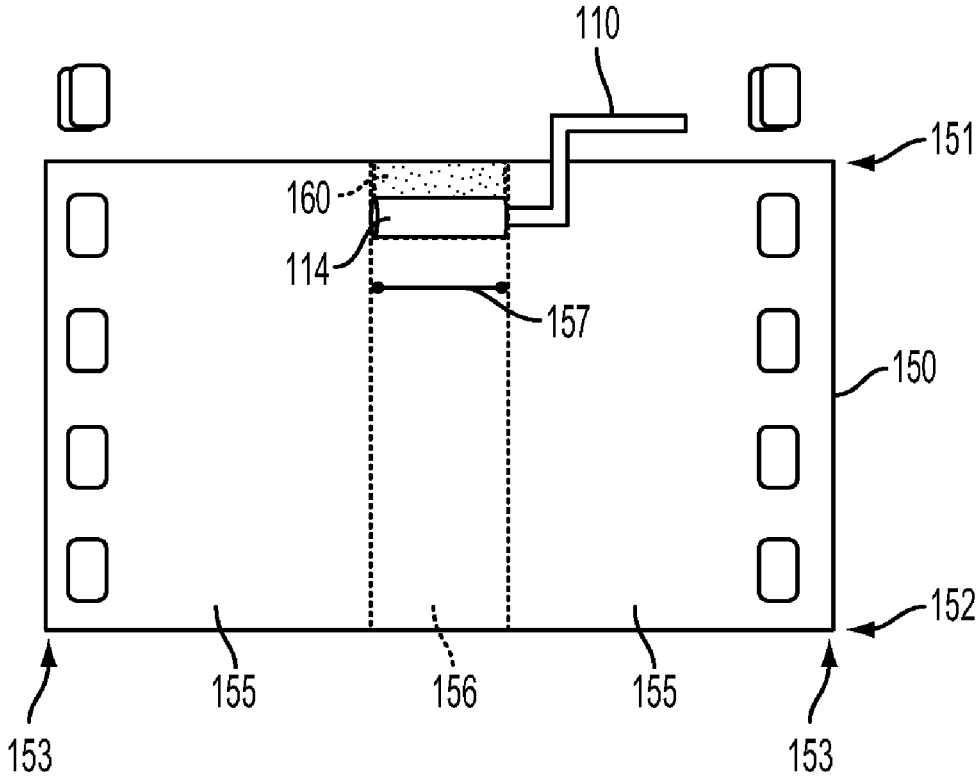
FIG. 4 is a schematic diagram illustrating yet another alternative liquid applicator that can be incorporated into the system of FIG. 1.

In one embodiment of the system 100, the liquid applicator 110 can comprise a spray nozzle 111 that sprays the liquid 160 onto the center portion 156 of the book cover 150. This spray nozzle 111 can have a spray pattern 162 with a width that is approximately equal to the width 157 of the center portion 156 so that the liquid 160 pools only the surface 158 of the center portion 156 without extending laterally across the side portions 155. Alternatively, the liquid applicator 110 can comprise any other suitable device for applying the liquid 160 and wetting the surface 158. For example, the liquid applicator 110 can comprise a sponge 112 (e.g., as shown in FIG. 2), a brush 113 (e.g., as shown in FIG. 3) or a passive (i.e., non-motorized) roller 114 (e.g., as shown in FIG. 4) that sponges, brushes or rolls, respectively, the liquid 160 onto the center portion 156 of the book cover 150. While such applicators 112, 113 and 114 apply the liquid 160 by contacting the surface 158, they do so with a single swiping motion as opposed to a scrubbing motion which might cause unacceptable damage to the surface 158 (e.g., tears, thinning, etc.). Such applicators 1112, 113, 114 can have a width that is approximately equal to the width 157 of the center portion 156 so that the liquid 160 pools only the surface 158 of the center portion 156 without extending laterally across the side portions 155. In any case, the system 100 can further comprise a liquid feed mechanism (e.g., a pump) that feeds (i.e., is adapted to feed, configured to feed, etc.) the liquid 160 via a hose or other liquid transport medium from a reservoir, which contains the liquid 160, to the applicator 110 (i.e., to the spray nozzle 111, sponge 112, brush 113 or passive roller 114, as appropriate). The liquid applicator 110 can automatically deactivate (i.e., turn off), after a predetermined period of time calculated to coincide with when the trailing edge 152 of the book cover 150 reaches the liquid applicator 110. Alternatively, the liquid applicator 110 can automatically deactivate (i.e., turn off), when the trailing edge 152 of the book cover 150 reaches the liquid applicator 110, as determined, for example, by an edge sensor.

Once the leading edge 151 of the book cover 150 reaches the liquid remover 120 (e.g., as determined by a leading edge sensor 140), the liquid remover 120 can automatically activate (i.e., turn on). As the book cover 150 passes by the liquid remover 120, the liquid remover 120 can remove (i.e., can be adapted to remove, configured to remove, etc.) the liquid 160 from the surface 158 of the center portion 156 of the book cover 150 from the leading edge 151 to the trailing edge 152. That is, the liquid remover 120 can essentially dry the surface 158.

Figure 5:
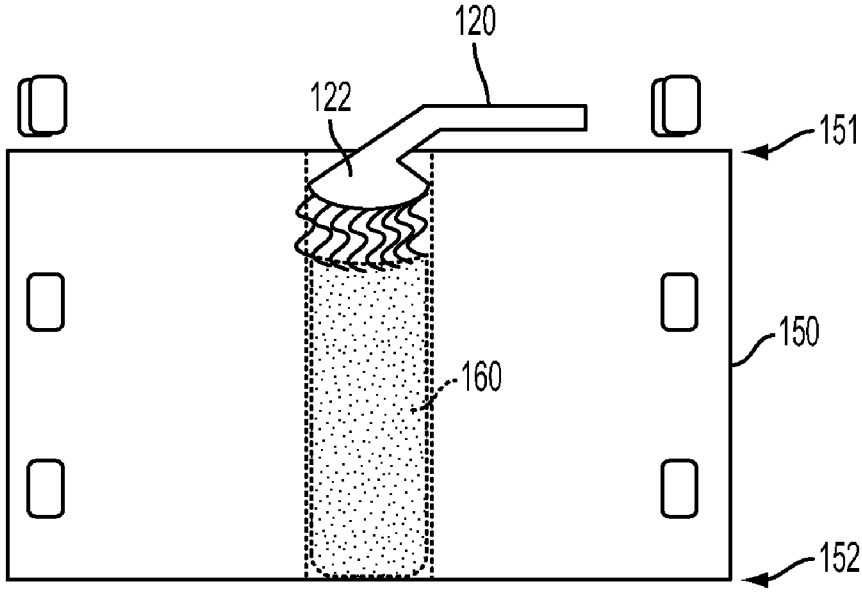
FIG. 5 is a schematic diagram illustrating an alternative liquid remover that can be incorporated into the system of FIG. 1.
Figure 6:
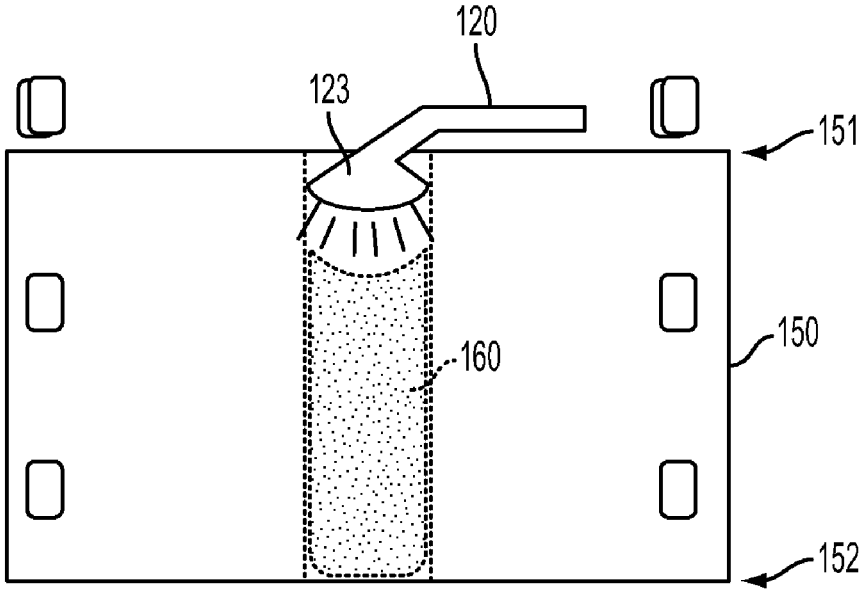
FIG. 6 is a schematic diagram illustrating another alternative liquid remover that can be incorporated into the system of FIG. 1.

In one embodiment of the system 100, the liquid remover 120 can comprise a vacuum nozzle 121 that vacuums away the liquid 160. For example, the vacuum nozzle 121 can be operatively connected to a vacuum source (e.g., a vacuum pump) via a duct so that vacuum pressure generated by the vacuum source and emanating from the vacuum nozzle 121 can lift the liquid 160 away from the book cover 150. Optionally, vacuum pressure settings can be selectively adjusted (i.e., the vacuum pressure created by the vacuum source can be varied) based on the weight of the book cover 150 to prevent damage to the book cover 150. The system 100 can be configured so that this selective adjustment process can be performed manually (i.e., by allowing a user to selectively adjust the vacuum source pressure setting) or automatically (e.g., based on measurements received from a sheet weight sensor). Alternatively, the liquid remover 120 can comprise any other suitable device for removing the liquid 160 and, thereby drying the book cover 150. For example, the liquid remover 120 can comprise a local heater 122 that evaporates away the liquid 160 (e.g., as shown in FIG. 5) and/or a blower 123 (i.e., a blow dryer) that blows away the liquid 160 (e.g., as shown in FIG. 6). The liquid remover 120 can automatically deactivate (i.e., turn off), after a predetermined period of time calculated to coincide with when the trailing edge 152 of the book cover 150 reaches the liquid remover 120. Alternatively, the liquid remover 120 can automatically deactivate (i.e., turn off), when the trailing edge 152 of the book cover 150 reaches the liquid remover 120, as determined, for example, by an edge sensor.

The sheet transport device(s) 130 can take (i.e., can be adapted to take, configured to take, etc.) a predetermined amount of time 180 (e.g., ½ of a second, 1 second, 5 seconds, etc.) to transport the book cover 150 from the liquid applicator 110, where the liquid 160 is applied, to the liquid remover 120, where the liquid 160 is removed. This predetermined amount of time 180 can comprise the required soak time and can be set so that the liquid 160 saturates the surface 158 of the center portion 156 of the book cover 150 and, thereby alters the surface structure of the center portion 156. For example, in the case of a paper book cover, this required soak time 180 can be set so that the liquid 160 (i.e., water or mixture of water and oil solvent) saturates the center portion 156 causing swelling of the paper fibers contained therein and resulting in an altered surface structure.

Altering the surface structure of the book cover 150 and, particularly, the surface structure of the center portion 156 (i.e., the spine portion) of the book cover 150 in this manner enhances adhesion of an adhesive material (e.g., glue or tape) to the center portion 156 during a subsequent book binding process and does so without requiring the removal of fuser oil remaining on the book cover 150 after it was printed, as discussed above. Specifically, the swelling of paper fibers in the center portion 156 (i.e., the spine portion) of the book cover separates the paper fibers from any fuser oil remaining after printing and increases the amount of quality surface area to which adhesive material (e.g., glue and/or tape) can adhere during book binding.

It should be noted that, depending upon the type of stock (i.e., material) used for the printed flexible book cover 150, the weight of the stock, any coatings or other surface treatments to the book cover, etc., the depth of the pool of liquid 160 (i.e., the height of the top of the liquid above the surface 158 of the book cover 150) and/or the required soak time 180 may be selectively adjusted in order to achieve the desired altered surface structure. In order to selectively adjust the depth of the pool of liquid 160 (e.g., from anywhere between 0.3-2 milliliter (ml)), the liquid applicator 110 can be configured so that the flow rate (e.g., unit volume per unit time) of liquid released by the liquid applicator can be selectively adjusted and, thereby so that a predetermined minimum depth can be achieved. A higher flow rate of liquid 160 can result in a deeper pool, which can be used to adequately treat a relatively thick coated paper book cover. A lower flow rate of liquid 160 can result in a shallower pool, which can be used to adequately treat a relatively thin uncoated paper book cover.

Furthermore, those skilled in the art will recognize that the soak time 180 in such a system 100 will depend upon the velocity at which the sheet transport device(s) 130 transport the book cover 150 as well as the physical distance travelled by the book cover 150 along the path 190 between the liquid applicator 110 and liquid remover 120. Thus, the sheet transport device(s) 130 can be operatively controlled by a drive mechanism (e.g., a servo mechanism) that can be selectively adjusted so that a predetermined sheet transport velocity can be achieved. A slower sheet transport velocity can result in a longer soak time, which can be used to adequately treat a relatively thick coated paper book cover. A faster sheet transport velocity can result in a shorter soak time, which can be used to adequately treat a relatively thin uncoated paper book cover. Additionally, or alternatively, the liquid applicator 110 and/or the liquid remover 120 can be movable (i.e., can be adapted to be moved, configured to be moved, etc.) so that the distance between them can to be varied. For example, the liquid applicator 110 and/or the liquid remover 120 can be operatively connected to a sliding track above the sheet transport path 190 and can be manually or automatically moved to any of a plurality of pre-set positions along the path 190. By moving the liquid applicator 110 and/or liquid remover 120 in this manner the distance between them can be selectively varied. A greater distance can result in a longer soak time, which can be used to adequately treat a relatively thick coated paper book cover. A shorter distance can result in a shorter soak time, which can be used to adequately treat a relatively thin uncoated paper book cover.

As mentioned above, the sheet transport device(s) 130 can transport the book cover 150 along the sheet transport path 190, in sheet form (e.g., sized between 8½×11 inches and 14.33×22.5 inches), past the liquid applicator 110, from the liquid applicator 110 to the liquid remover 120 and past the liquid remover 120. The sheet transport device(s) 130 can do so (i.e., can be adapted to do so, configured to do so, etc.) without contacting the liquid 160 on the surface 158 of the book cover 150. To accomplish this, the sheet transport device (s) 130 can comprise, for example, a plurality of nip rollers (as shown) engaging the side edges 153 only of the book cover 150, where the side edges 153 are essentially perpendicular to the leading and trailing edges 151, 152 and are essentially parallel to the center portion 156. Alternatively, the sheet transport device(s) 130 can comprise electrostatic transport belt(s). Side edge nip rollers and electrostatic transport belts are well-known in the art. Thus, the details of such transport devices are omitted from this specification in order to allow the reader to focus on the salient aspects of the invention.

The system 100, as described above and illustrated in FIG. 1, can comprise a discrete system for treating a printed flexible book cover 150. That is, printed flexible book covers can be fed (e.g., from a feeding tray) directly into the system 100, treated (i.e., wet by liquid applicator 110 and dried by liquid remover 120), and then output (e.g., into an output tray). Treated book covers output from the system 100 can be stored or shipped to another processing facility and, then, subsequently used in a discrete book binding process (e.g., a perfect bound book binding process or other book binding process, such as a tape binding process). Alternatively, the system 100, as described above and illustrated in FIG. 1, can comprise a subsystem integrated into a primary system, which provides for a combination of processing functions, including a treating function. For example, such a primary system can include printing and treating sub-systems; treating and binding subsystems; printing, treating and binding subsystems, etc.).

Optionally, a controller 170 can be in communication with and can control operation of the system 100 and the various components contained therein, including but not limited to the sheet transport device(s) 130, the liquid applicator 110, the liquid remover 110 and the edge sensors 140. This controller 170 can comprise, for example, a programmable, self-contained, dedicated mini-computer having a central processor unit (CPU), electronic storage, and a display or user interface (UI). Optionally, if the treating system 100 is a subsystem integrated into primary system, this controller 170 can function as the main controller for primary system.

Figure 7:
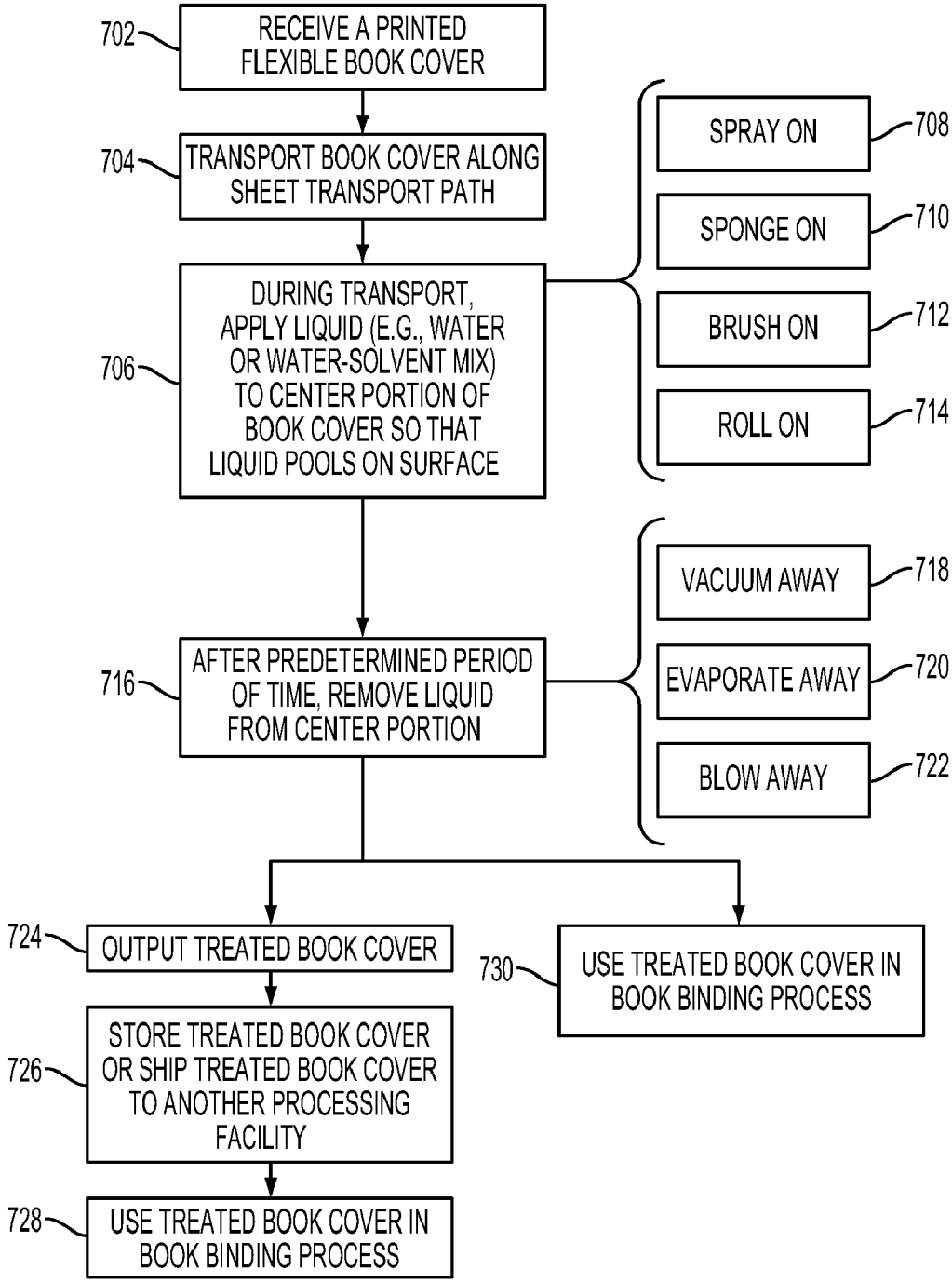
FIG. 7 is a flow diagram illustrating a method for treating a printed flexible book cover prior to book binding.

Referring to FIG. 7 in combination with FIG. 1, also disclosed herein are embodiments of an associated method for treating a printed flexible book cover 150 prior to book binding. The method embodiments can comprise receiving a flexible book cover 150 in sheet form (e.g., sized between 8½×11 inches and 14.33×22.5 inches) (702). This flexible book cover 150 can be received at the beginning of a sheet transport path 190. It can comprise a soft cover book cover (e.g., a paper book cover) and can be printed (e.g., by an electrostatographic image reproduction machine, as discussed above and shown in FIG. 8) with toner images fused onto one or both surfaces (i.e., on the inside surface 158 and/or the outside surface). Thus, both the inside surface 158 and outside surface of the book cover 150 may contain transferred fuser oil. This book cover 150 can further comprise side portions 155 (i.e., front and back cover portions) and a center portion 156 (i.e., a spine portion) positioned laterally between the side portions 155. The center portion 156 can extend from a first edge 151 of the book cover 150 to a second edge 152 opposite the first edge 151. The book cover 150 can be received at process 702, for example, from a feeding tray containing a stack of such printed flexible book covers. Alternatively, the printed flexible book cover 150 can be received at process 702 directly from another processing system (e.g., a printing system, or a coating system).

The method embodiments can further comprise transporting the book cover 150 along the sheet transport path 190 (704). As the book cover 150 is being transported along the sheet transport path 190 at process 704, it can be oriented such that the first edge 151 is the leading edge and the second edge 152 is the trailing edge. This transporting process 704 can be accomplished, for example, by one or more sheet transport devices 130.

During this transporting process 704, a liquid 160 can be applied to a surface 158 of the center portion 156 of the book cover 150 from the leading edge 151 to the trailing edge 152 (706). Specifically, this process 706 can be accomplished through the use of a liquid applicator 110 and can begin automatically when the leading edge 151 of the book cover 150 reaches the liquid applicator 110 (e.g., as determined by an edge sensor 140) This liquid 160 can be applied such that a pool of the liquid 160 (i.e., a standing puddle, a collection, etc.) covers the center portion 156 without extending laterally across the side portions 155 (i.e., such that the liquid pools on only the center portion 156 of the book cover).

The liquid 160 can comprise, for example, purified water. Alternatively, the liquid 160 can comprise a mixture of water and an oil solvent (e.g., a commercially available oil solvent, such as an Eatoils™ product).

In one embodiment of the method, the process 706 of applying the liquid 160 can comprise spraying the liquid 160 onto the center portion 156 of the book cover 150 (e.g., using a spray nozzle 111) (708). This spray nozzle 111 can have a spray pattern 162 with a width that is approximately equal to the width 157 of the center portion 156 so that the sprayed on liquid 160 pools only the surface 158 of the center portion 156 without extending laterally across the side portions 155. Alternatively, any other suitable technique can be used at process 706 for applying the liquid 160 to the surface 158. For example, the liquid 160 can be applied by sponging it on (710, see sponge 112 in FIG. 2), brushing it on (712, see brush 113 in FIG. 3) or rolling it on (714, see passive roller 114 in FIG. 4). With such techniques, the liquid 160 should be applied by a single swiping motion, avoiding a scrubbing motion that might cause unacceptable damage to the surface 158 (e.g., tears, thinning, etc.). Additionally, with such techniques, the width of the applicators 112, 113, 114 should be approximately equal to the width 157 of the center portion 156 of the book cover 150 so that the liquid 160 pools only on the surface 158 of the center portion 156 without extending laterally across the side portions 155. Application of the liquid 160 at process 706 can cease automatically, after a predetermined period of time calculated to coincide with when the trailing edge 152 of the book cover 150 reaches the liquid applicator 110. Alternatively, application of the liquid 160 at process 706 can cease automatically, when an edge sensor determines that the trailing edge 152 of the book cover 150 has reached the liquid applicator 110.

After a predetermined amount of time 180, the liquid 160 can be removed from the surface 158 (i.e., the surface 158 can be dried) (716). In one embodiment of the method, the liquid 160 can be removed at process 716 by vacuuming it away (718). For example, the center portion 156 of the book cover 150 can be transported along the sheet transport path 190 past a vacuum nozzle 121, which is operatively connected to a vacuum source (e.g., a vacuum pump) via a duct, so that vacuum pressure generated by the vacuum source and emanating from the vacuum nozzle 121 can lift the liquid 160 away from the book cover 150. Optionally, vacuum pressure settings can be selectively adjusted (i.e., the vacuum pressure created by the vacuum source can be varied) based on the weight of the book cover 150 to prevent damage to the book cover 150. Alternatively, the liquid 160 can be removed at process 716 by applying heat to evaporate it away (720, see local heater 122 in FIG. 5) and/or by blowing it away (722, see blower 123 in FIG. 6). Removal of the liquid 160 at process 716 can cease automatically, after a predetermined period of time calculated to coincide with when the trailing edge 152 of the book cover 150 reaches the liquid remover 120. Alternatively, removal of the liquid 160 at process 160 can cease automatically, when an edge sensor determines that the trailing edge 152 of the book cover 150 has reached the liquid remover 120.

The predetermined amount of time 180 (e.g., ½ of a second, 1 second, 5 seconds, etc.) referred to at process 716 to transport the book cover 150 from the liquid applicator 110, where the liquid 160 is applied, to the liquid remover 120, where the liquid 160 is removed can comprise the required soak time. This required soak time 180 can be set so that the liquid 160 saturates the center portion 156 the book cover 150 and, thereby alters the surface structure of the center portion 156. For example, in the case of a paper book cover, this required soak time 180 can be set so that the liquid 160 (i.e., water or mixture of water and oil solvent) saturates the center portion 156 causing swelling of the paper fibers contained therein and resulting in an altered surface structure.

Altering the surface structure of the book cover 150 and, particularly, the surface structure of the center portion 156 (i.e., the spine portion) of the book cover 150 in this manner enhances adhesion of an adhesive material (e.g., glue or tape) to the center portion 156 during a subsequent book binding process and does so without requiring removal of fuser oil remaining on the book cover 150 after it was printed, as discussed above. Specifically, the swelling of paper fibers in the center portion 156 (i.e., the spine portion) of the book cover separates the paper fibers from any fuser oil remaining after printing and increases the amount of quality surface area to which adhesive material (e.g., glue and/or tape) can adhere during book binding.

It should be noted that, depending upon the type of stock (i.e., material) used for the printed flexible book cover 150, the weight of the stock, any coatings or other surface treatments to the book cover, etc., the depth of the pool of liquid 160 (i.e., the height of the top of the liquid above the surface 158 of the book cover 150) as applied at process 706 and/or the required soak time 180 referred to at process 716 may be selectively adjusted in order to achieve the desired altered surface structure (see detailed discussion above with regard to the system embodiments).

Once a book cover is treated (e.g., wet at process 706 and dried at process 716), it can be output (e.g., into an output tray) (724). Treated book covers can be stored or shipped to another processing facility (726) and, then, subsequently used in a discrete book binding process (e.g., a perfect bound book binding process or other book binding process, such as a tape binding process) (728). Alternatively, instead of being output to an output tray and stored or shipped, a treated book cover can be immediately used in a book binding process (e.g., a perfect bound book binding process or other book binding process, such as a tape binding process) (730). Treating the center portion 156 of the book cover in the manner described above at processes 706 and 716 enhances adhesion of any adhesive material (e.g., glue or tape) applied to the center portion 156 during such book binding processes 728 or 730 and does so without requiring actual removal of fuser oil remaining on the book cover 150 after it was printed by a cleaning process.

Also disclosed herein are embodiments of a computer program product. This computer program product can comprise a computer-usable (i.e., computer-readable) medium on which a computer-useable (i.e., computer-readable) program code (i.e., a control program, a set of executable instructions, etc.) is recorded and stored or embodied. Specifically, the computer-useable medium can comprise a tangible, non-transitory, storage medium (i.e., a memory device) on which the program is recorded and stored. Exemplary forms of such a tangible, non-transitory, storage medium include, but are not limited to, a magnetic storage medium (e.g., a floppy disk, a flexible disk, a hard disk, a magnetic tape or any other magnetic storage medium), an optical storage medium (e.g., a CD-ROM, DVD or any other optical storage medium), or a memory chip or cartridge (e.g., a RAM, a PROM, an EPROM, a FLASH-EPROM, or any other memory chip or cartridge). Alternatively, the computer-useable medium can comprise a transmission medium in which the program is embodied as a data signal. Exemplary forms of a transmission medium include, but are not limited to, an acoustic wave generated during radio wave communication, a light wave generated during infrared data communication or any other transmission medium from which a computer can read and use program code. The computer-usable program code can be read and executed by a computer (e.g., by the controller 170 of FIG. 1) in order to perform a method for treating a book cover prior to book binding (e.g., as described above and illustrated in FIG. 7).

Many computerized devices are discussed above (e.g., see the controller 170). Such computerized devices typically include chip-based central processing units (CPU's), input/output devices (including graphic user interfaces (GUI)), electronic storage memories, comparators, processors, etc. Such computerized devices are generally well-known in the art and are readily available from manufacturers such as Dell Computers, Round Rock Tex., USA and Apple Computer Co., Cupertino Calif., USA. Thus, the details of such computerized devices are omitted from this specification in order to allow the reader to focus on the salient aspects of the embodiments disclosed.

The words "printer", "print engine", "image reproduction machine", or "image output terminal" as used herein encompasses any apparatus, such as a digital copier, bookmaking machine, facsimile machine, multi-function machine, etc. which performs a print outputting function for any purpose. The details of such printers, printing engines, etc. are well-known in the art and are discussed, for example, in U.S. Pat. No. 6,032,004, the complete disclosure of which is fully incorporated herein by reference. Such printers, printing engines, etc. can print in color, monochrome, or both and can comprise electrostatographic and/or xerographic printers, print engines, etc.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

Therefore, disclosed above are embodiments of a system and method for treating a printed flexible book cover (i.e., a soft cover book cover, such as a paper book cover) and, particularly, the spine portion of a printed flexible book cover prior to book binding. Specifically, in the embodiments, a liquid (e.g., water or a mixture of water and an oil solvent) can be applied (e.g., by a liquid applicator, such as a spray nozzle, sponge, brush, etc.) to the spine portion of a printed flexible book cover so that it pools on the surface. Then, after a predetermined amount of time, the liquid can be removed (e.g., by a liquid remover, such as a vacuum, blower, heater, etc.). Allowing the spine portion of the book cover to soak in the liquid for this predetermined amount of time ensures that the liquid saturates the spine portion. Saturating the spine portion of the printed flexible book cover alters the surface structure and, thereby enhances adhesion of an adhesive material (e.g., glue or tape) during a subsequent book binding process (e.g., a perfect bound book binding process or a tape binding process) even in the presence of fuser oil.

What is claimed is:

1. A method comprising:

receiving a paper book cover in sheet form, said paper book cover comprising side portions and a center portion positioned laterally between said side portions, said center portion extending from a first edge to a second edge of said paper book cover;

applying a liquid to a surface of said center portion such that a pool of said liquid covers said center portion without extending laterally across said side portions; and after a predetermined amount of time and before application of an adhesive material to said center portion of said paper book cover during a book binding process, removing said liquid from said surface, said predetermined amount of time ensuring that said liquid saturates and causes swelling of paper fibers in said center portion of said paper book cover so that a structure of said surface of said center portion of said paper book cover is altered.

2. The method of claim 1, said structure of said surface being altered in order to enhance adhesion of said adhesive material to said center portion during said book binding process without requiring a discrete process for removal of fuser oil remaining on said surface following a previous printing process.

3. The method of claim 1, said applying of said liquid comprising any of spraying on said liquid, sponging on said liquid, brushing on said liquid, and rolling on said liquid.

4. The method of claim 1, said removing of said liquid comprising any of vacuuming away said liquid, applying heat to evaporate away said liquid and blowing away said liquid.

5. The method of claim 1, said applying of said liquid comprising spraying on said liquid using a spray nozzle having a spray pattern, said spray pattern and said center portion having approximately equal widths.

6. The method of claim 1, said liquid comprising any one of the following:

purified water only; and a mixture comprising only water and an oil solvent.

7. A method comprising:

receiving a paper book cover in sheet form, said paper book cover comprising side portions and a center portion positioned laterally between said side portions, said center portion extending from a first edge to a second edge of said paper book cover;

spraying purified water only onto a surface of said center portion such that a pool of said water covers said center portion without extending laterally across said side portions; and after a predetermined amount of time and before application of an adhesive material to said center portion of said paper book cover during a book binding process, vacuuming said purified water away from said surface, said predetermined amount of time ensuring that said purified water saturates and causes swelling of paper fibers in said center portion of said paper book cover so that a structure of said surface of said center portion of said paper book cover is altered.

8. The method of claim 7, said structure of said surface being altered in order to enhance adhesion of adhesive material to said center portion of said paper book cover during said book binding process without requiring a discrete process for removal of fuser oil remaining on said surface following a previous printing process.

9. The method of claim 7, said predetermined amount of time being approximately 1 second.

10. The method of claim 7, said spraying comprising spraying using a spray nozzle having a spray pattern, said spray pattern and said center portion having approximately equal widths.

11. A system comprising:

a liquid applicator applying a liquid to a surface of a center portion of a paper book cover, said paper book cover being in sheet form and said center portion being positioned laterally between side portions of said book cover and further extending from a leading edge to a trailing edge of said book cover and said applying being performed by said liquid applicator such that a pool of said liquid covers said center portion without extending laterally across said side portions;

a liquid remover removing said liquid from said surface; and at least one sheet transport device transporting said book cover from said liquid applicator to said liquid remover, said transporting taking a predetermined amount of time so that said liquid saturates and causes swelling of paper fibers in said center portion of said paper book cover so that a structure of said surface of said center portion is altered before an adhesive material is applied to said center portion f said paper book cover during book binding.

12. The system of claim 11, said liquid applicator applying said liquid by any of spraying, sponging, brushing, and rolling.

13. The system of claim 11, said liquid remover removing said liquid by any of vacuuming, heating and blowing.

14. The system of claim 11, said liquid applicator comprising a spray nozzle having a spray pattern, said spray pattern and said center portion having approximately equal widths.

15. The system of claim 11, said liquid comprising any one of the following:

purified water only; and a mixture of only water and an oil solvent.

16. The system of claim 11, said at least one sheet transport device transporting said book cover without contacting said liquid, said at least one sheet transport device comprising any of the following:

an electrostatic transport belt; and, a plurality of nip rollers engaging side edges of said book cover, said side edges being essentially perpendicular to said leading edge and said trailing edge and essentially parallel to said center portion.

17. A system comprising:

a water applicator spraying purified water only onto a surface of a center portion of a paper book cover, said paper book cover being in sheet form and said center portion being positioned laterally between side portions of said book cover and further extending from a leading edge to a trailing edge of said book cover and said spraying being performed such that a pool of said water covers said center portion without extending laterally across said side portions;

a vacuum vacuuming said purified water away from said surface; and at least one sheet transport device transporting said book cover from said water applicator to said vacuum, said transporting taking a predetermined amount of time so that, prior to removal, said purified water saturates and causes swelling of paper fibers in said center portion of said paper book cover so that a structure of said surface of said center portion is altered prior to book binding.

18. The system of claim 17, said predetermined amount of time being approximately 1 second.

19. The system of claim 17, said water applicator comprising a spray nozzle with a spray pattern, said spray pattern and said center portion having approximately equal widths.

20. The system of claim 17, said at least one sheet transport device transporting said book cover without contacting said purified water, said at least one sheet transport device comprising any of the following:

an electrostatic transport belt; and, a plurality of nip rollers engaging side edges of said book cover, said side edges being essentially perpendicular to said leading edge and said trailing edge and essentially parallel to said center portion.

* * * * *